United States Patent [19]

Lokken

[11] Patent Number: 4,848,666

[45] Date of Patent: Jul. 18, 1989

[54] NOZZLE HEAD, ESPECIALLY FOR USE IN A DE-ICING DEVICE FOR AIRCRAFT

[75] Inventor: Ivar Lokken, Åsmarka, Norway

[73] Assignee: Moelven Mekaniske Industri A/S, Moelv, Norway

[21] Appl. No.: 245,313

[22] Filed: Sep. 16, 1988

[30] Foreign Application Priority Data

Sep. 29, 1987 [NO] Norway ..... 874089

[51] Int. Cl.[4] ..... A62C 31/00; B05B 1/32; B05B 1/30

[52] U.S. Cl. ..... 239/438; 239/444; 239/459; 239/583

[58] Field of Search ..... 239/455–459, 239/438, 444, 583

[56] References Cited

U.S. PATENT DOCUMENTS

| | | | |
|---|---|---|---|
| 2,796,296 | 6/1957 | Campbell | 239/456 X |
| 3,746,262 | 7/1973 | Bete | 239/458 |
| 3,791,584 | 2/1974 | Drew | 239/456 X |
| 4,248,385 | 2/1981 | Hickerson | 239/444 |
| 4,252,278 | 2/1981 | McMillan | 239/583 |

FOREIGN PATENT DOCUMENTS

| | | | |
|---|---|---|---|
| 277067 | 5/1913 | Fed. Rep. of Germany | 239/438 |
| 1151856 | 5/1969 | United Kingdom | 239/457 |

*Primary Examiner*—Andres Kashnikow
*Assistant Examiner*—Patrick M. Burkhart
*Attorney, Agent, or Firm*—Browdy and Neimark

[57] ABSTRACT

The invention relates to a nozzle head, especially for use in a de-icing device for aircraft, to emit a liquid in the form of a spray. The nozzle head comprises a supply chamber for the liquid, a nozzle ring member, and a central member which is provided in the latter and is movable by the aid of a set means for adjustment of the spray in the nozzle axis, and which in one end position will close the connection between the nozzle annulus formed by the nozzle ring member, and the central member and the supply chamber. The nozzle head is characterized by the fact that the central member constitutes the nozzle ring member of a concentric inner nozzle with a central pin which is operatively connected with said set means and is connected with the central member by a free play spring, so that the central pin is not displaced until said central member is in its mentioned end position in which position the inner nozzle is at the same time put in liquid flow connection with the supply chamber of the nozzle head.

1 Claim, 1 Drawing Sheet

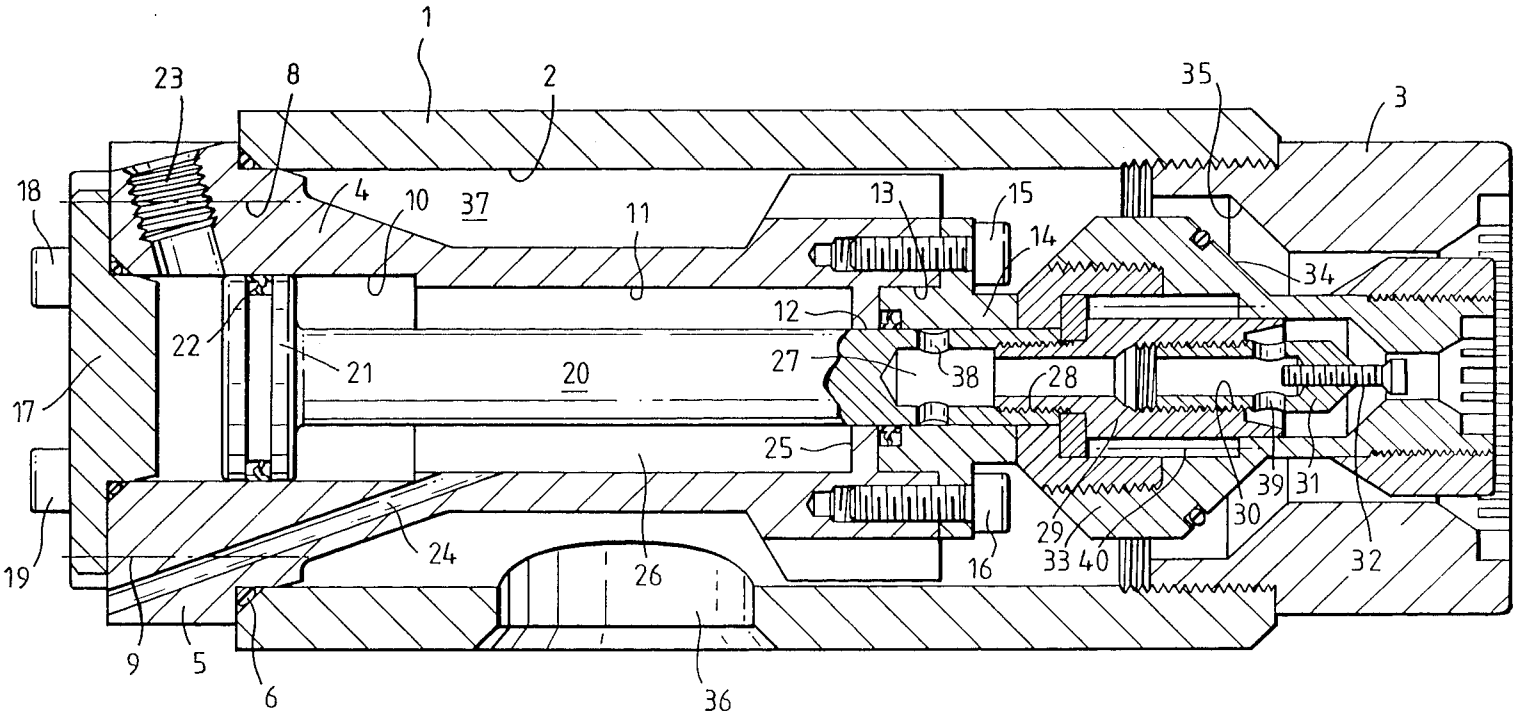
3
35
34
32
31
39
30
40
33
29
28
14
15
16
38
13
12
27
25
36
11
26
20
2
37
1
10
24
4
21
8
6
22
5
23
9
18
17
19

NOZZLE HEAD, ESPECIALLY FOR USE IN A DE-ICING DEVICE FOR AIRCRAFT

The invention relates to a nozzle head, especially for use in a de-icing device for aircraft, to emit a liquid in the form of a spray, said nozzle head comprising a supply chamber for the liquid, a nozzle ring member, and a central member which is provided in the latter for adjustment of the spray in the nozzle axis and is movable by the aid of a setting means, and which in one end position will close the connection between the nozzle annulus formed by the nozzle ring member and the central member, and the supply chamber.

The invention was especially developed for use in a de-icing device for aircraft but it is not limited to such utilization exclusively.

In case of de-icing an aircraft on the ground a mixture of water and glycol is sprayed onto the wings, and the rudder, and elevator. If the aircraft stays on the ground for a long time, e.g. is parked for the night, it will often be desired or necessary to spray a coating, substantially in the form of pure glycol onto said aircraft surfaces. Such coating spray requires a different nozzle head from the head used for the first mentioned spray operations which are typically carried out immediately before departure.

The nozzle head is mounted so as to be able to make large swiveling movement about the X-axis as well as the Y-axis. There is, thus, a demand for a nozzle head which may be used for both kinds of spray operations.

According to the invention a nozzle head is, thus, proposed, especially for use in a de-icing device for aircraft, to emit a liquid in the shape of spray, with said nozzle head comprising a supply chamber for the liquid, a nozzle ring member, and a central member which is provided in the latter for adjustment of the spray in the nozzle axis, being movable by the aid of a setting means, and which in one end position will close the connection between the nozzle annulus formed by the nozzle ring member and the central member, and the supply chamber, which nozzle head is characterized by the fact that the central member forms the nozzle ring member for a concentric internal nozzle which has a central in which is operationally connected to said setting means and connected with the central member by a free play spring, so that the central pin is not displaced until said central member is in its mentioned end position, in which the internal nozzle is at the same time moved into a liquid flow connection with the supply chamber of the nozzle head.

By such a nozzle head an advantageous combination of two nozzles in one and the same head is achieved. The nozzle annulus shaped by the outer nozzle ring member and the central member is supplied with liquid, i.e. a mixture of water and glycol, from the supply chamber. For adjustment of the spray the central member is displaced by a suitable setting means. When it is desirable to use the de-icing device to spray a coating, mainly consisting of pure glycol, the outer nozzle is closed by moving the central member into its closing position by the aid of the setting means. By continued activation by the aid of said setting mean the free play spring will now give way causing the central pin to be displaced in the central member for adjustment of the desired shape of the spray in the inner nozzle. At the same time as the central member is moved into its closing end position a liquid flow connection between inner nozzle and supply chamber is opened. Both-nozzles may, thus, be used independently and may be adjusted by one and the same setting means. Both nozzles are assembled in one nozzle head which is suspended in a manner known per se permitting movement in the X-axis and Y-axis. Movement in the Z-axis occurs by the aid of the arm on which the nozzle head is provided in the de-icing device.

Further features of the invention will appear from the following disclosure of an embodiment, and from the claims.

In the figure of the drawing a longitudinal section through a nozzle head according to the invention is shown.

The nozzle head shown in the figure comprises a casing 1 with a cylindrical bore 2. Casing 1 has a quadratic external cross sectional shape.

A nozzle ring member 3 is screwed into one end of the casing. From the other end of the casing a cylindrical member 4 is inserted. Cylindrical member 4 is provided with a head 5 with an annular shoulder contact surface 6 which in the position of cylindrical member 4 shown in the figure is in sealing contact with an O-ring 7 which is placed in a bevelled portion at the end of cylindrical bore 2 in casing 1. Head 5 of the cylindrical member is secured to casing 1 by the aid of screws 8 and 9 indicated by dash-point-lines.

As shown, cylindrical member 4 has a cylindrical bore 10 opening into a slightly narrower cylindrical bore 11 which is followed by a still narrower cylindrical bore 12 close to the end of cylindrical member 4 which projects into cylindrical bore 2 of casing 1. At this end of cylindrical member 4 there is a cylindrical bore 13 having a piston rod control 14 inserted into it. Said piston rod control is kept in place by screws 15, 16. At the other end of cylindrical member 4 an end cover 17 is screwed onto head 5 by the aid of indicated screws 18, 19.

A piston rod 20 extends through piston rod control 14 and is expanded in bore 10 to form a piston 21. Piston 21 has an annular groove with a gasket 22 tightening against the cylindrical walls in cylindrical bore 10.

In head 5 of the cylindrical member 4 a threaded transverse bore 23 is provided for connection with a hydraulic conduit. A bore 24 acts as a ventilating bore between the surroundings and cylindrical space 11 behind piston 22. In cylindrical space 11 a helical spring 26 is provided in contact with annular surface 25 and with its other end acting on piston 21.

As shown, piston rod 20 projects outside piston rod control 14 and is at this end provided with a blind bore 27. Blind bore 27 is provided with a threaded portion 28 into which a control member 29 is screwed. As shown, control member 29 is provided with a through bore having an expanded threaded portion 30. Into the latter a holder means 31 is screwed and a central pin 32 is screwed into holder means 31.

A central member 33 is designed as shown to surround central pin and control member. Central member 33 also sits on the end of piston rod 20 and is in contact with piston rod control 14 Central member 33 is provided with an enlarged portion having a conical surface 34 with an inserted 0-ring intended for sealing cooperation with the conical surface 35 inside nozzle ring member 3.

The nozzle head performs as follows. In the position shown in the figure of the drawing the nozzle head is supplied with a mixture of water and glycol through orifice 36 which opens in the supply chamber 37 formed between cylindrical bore 2 of the casing and cylindrical member 4. The liquid mixture can flow towards the right hand side and out through the nozzle annulus prevailing between nozzle member 3 and central member 33. Central member 33 may be displaced axially by supply of pressurized oil through transversal bore 23, causing piston 22 to move towards the right hand side in the figure. Spring 26 is, thus, compressed. Spring 26 acts as a return spring and will return piston 22 to its original position again when the pressure is relieved in transversal bore 23.

When it is desirable to use the inner nozzle formed between central member 33 and central pin 32, oil pressure is made to act on piston 22 through transversal bore 23, so that piston 22 and, thus, piston rod 20 move towards the right hand side to displace central member 33 in contact with the conical surface 35 in nozzle ring member 3. The connection between supply chamber 37 and outer nozzle is, thus, closed. At the same time transversal bores 38 are, however, exposed as they are displaced to the right hand side to get clear of piston rod control 14. Now, liquid can flow from supply chamber 37 into blind bore 27 and onwards to the right and out into inner nozzle through transversal bores 39 in holder member 31. Continued movement of piston 22 will cause a spring 40 to yield, so that control member 29 and the holder which is screwed into the latter with central pin 32 are moved to the right causing adjustment of the spray of inner nozzle. By the aid of an external valve (not shown) the supply through orifice 36 is set so that pure glycol is supplied in this operational position.

When spraying with the inner nozzle is concluded the pressure on piston 22 is relieved. Piston 22 will then move towards the left hand side and inner nozzle is closed against supply chamber 37 at the same time as outer nozzle is opened and ready for use.

Having Describe my invention, I claim:

1. A nozzle head, especially for use in a de-icing device for air craft, to emit a liquid in the form of a spray, said nozzle head comprising: a supply chamber for the liquid; a nozzle ring member;

a central member provide in said nozzle ring member, said central member being movable along a nozzle axis for adjustment of the spray, said central member being movable into an end position closing a nozzle annulus formed by the nozzle ring member, the central member, and the supply chamber;

a central pin forming a concentric inner nozzle with said central member, the central pin being movable along the longitudinal axis of the nozzle and connected to said central member by means of a spring; means for providing axial movement of said central member and said central pin; wherein said central pin is in direct operational contact with said means for providing axial movement so that the central pin and the central member are at first displaced together;

wherein the central pin is not displaced relative to the central member until the central member has reaches said end position; whereby displacement of said central pin with respect to said central member puts the inner nozzle into fluid communication with said supply chamber.

* * * * *